US009959802B1

(12) United States Patent
Jiang et al.

(10) Patent No.: US 9,959,802 B1
(45) Date of Patent: May 1, 2018

(54) SYSTEM AND METHOD FOR IMAGE PROCESSING AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Beijing (CN)

(72) Inventors: Xue Jiang, Beijing (CN); Xinghua Li, Beijing (CN); Seungyik Park, Beijing (CN)

(73) Assignees: BOE TECHNOLOGY GROUP CO., LTD., Beijing (CN); CHENGDU BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days. days.

(21) Appl. No.: 15/555,326

(22) PCT Filed: Jan. 18, 2017

(86) PCT No.: PCT/CN2017/071520
§ 371 (c)(1),
(2) Date: Sep. 1, 2017

(87) PCT Pub. No.: WO2017/193631
PCT Pub. Date: Nov. 16, 2017

(30) Foreign Application Priority Data

May 11, 2016 (CN) ..... 2016 1 0310700

(51) Int. Cl.
*G09G 5/02* (2006.01)
*G09G 3/20* (2006.01)
*G09G 3/36* (2006.01)

(52) U.S. Cl.
CPC ..... *G09G 3/2074* (2013.01); *G09G 3/2003* (2013.01); *G09G 3/3685* (2013.01);
(Continued)

(58) Field of Classification Search
CPC ..... G02F 1/133; G09G 2300/0426; G09G 2320/0233; G09G 2320/0247;
(Continued)

(56) References Cited

U.S. PATENT DOCUMENTS

2002/0180999 A1 12/2002 Kanai
2004/0169627 A1* 9/2004 Hong ..... G09G 3/3696 345/89

(Continued)

FOREIGN PATENT DOCUMENTS

CN 1804988 A 7/2006
CN 101779231 A 7/2010

(Continued)

OTHER PUBLICATIONS

Office Action from corresponding Chinese Application No. 201610310700.X, dated Sep. 4, 2017 (5 pages).

(Continued)

*Primary Examiner* — Insa Sadio
(74) *Attorney, Agent, or Firm* — Harness, Dickey & Pierce, P.L.C.

(57) ABSTRACT

Exemplary embodiments of the present disclosure relate to a system and method for image processing, and a display device. The system comprises: a greyscale value selection module for selecting a plurality of color greyscale values for each sub-pixel, the sub-pixel being used for displaying an image; an optimal common voltage determination module for determining an optimal common voltage of each sub-pixel according to the selected color greyscale values for each sub-pixel; a uniformity determination module compris- (Continued)

ing a flicker uniformity determination module and a common voltage uniformity determination module, the flicker uniformity determination module being used for determining the flicker uniformity of each sub-pixel, the common voltage uniformity determination module being used for determining the common voltage uniformity of each sub-pixel according to the determined flicker uniformity of each sub-pixel; and an image compensation module for compensating each sub-pixel according to at least one of the optimal common voltage of each sub-pixel and the common voltage uniformity of each sub-pixel, thereby improving the residual image and flicker uniformity at the time of image display.

20 Claims, 5 Drawing Sheets

(52) U.S. Cl.
CPC . *G09G 2310/027* (2013.01); *G09G 2310/061* (2013.01); *G09G 2320/0204* (2013.01); *G09G 2320/0247* (2013.01); *G09G 2320/0257* (2013.01); *G09G 2320/0666* (2013.01)

(58) Field of Classification Search
CPC ..... G09G 2320/0276; G09G 3/36; G09G 3/3614; G09G 3/3648
See application file for complete search history.

(56) References Cited

U.S. PATENT DOCUMENTS

| | | | | |
|---|---|---|---|---|
| 2006/0152462 | A1* | 7/2006 | Furihata | G09G 3/3655 345/98 |
| 2010/0118044 | A1 | 5/2010 | Ishihara | |
| 2013/0021227 | A1 | 1/2013 | Saigo | |
| 2016/0343317 | A1* | 11/2016 | Syu | G02F 1/133 |

FOREIGN PATENT DOCUMENTS

| | | | |
|---|---|---|---|
| CN | 103185974 | A | 7/2013 |
| CN | 103456278 | A | 12/2013 |
| CN | 104347048 | A | 2/2015 |
| CN | 105741813 | A | 7/2016 |
| JP | 2002262304 | A | 9/2002 |
| JP | 2013025140 | A | 2/2013 |
| JP | 2016021059 | A | 2/2016 |

OTHER PUBLICATIONS

Written Opinion of the International Searching Authority from corresponding PCT Application No. PCT/CN2017/071520, dated May 2, 2017 (4 pages).

* cited by examiner

SYSTEM AND METHOD FOR IMAGE PROCESSING AND DISPLAY DEVICE

CROSS-REFERENCE TO RELATED APPLICATION

This application claims the benefit and priority of Chinese Patent Application No. 201610310700.X, filed on May 11, 2016, the entire content of which is incorporated by reference herein.

FIELD

Exemplary embodiments of the present disclosure relate to the field of image processing, and more particularly, to a system and method for image processing, and a display device.

BACKGROUND

Various kinds of materials, such as liquid crystal, alignment film, sealant and so on, are used in the process of producing a liquid crystal display. As the materials cannot be completely purified, charges inevitably exist and gradually accumulate in the process of use of the liquid crystal display. When driven by alternating voltage, if there is a deviation in the polarity of the driving voltage (for example, there is a bias voltage between the positive and negative voltage of the liquid crystal and the common electrode voltage), the residual charges in the liquid crystal cell will significantly affect the liquid crystal deflection angle after a certain period of time, thereby resulting in the occurrence of a residual image.

In a traditional liquid crystal display, the residual image problem caused by liquid crystal polarization in the liquid crystal display is improved mainly from two aspects, process material and drive signal. Drive signal optimization is mainly performed by adjusting the polarity of the driving signal voltage and dynamically refreshing the image. Since the process of adjusting the polarity of the driving signal voltage is complex and it is difficult to accurately set the compensation amount, and different display areas often require driving signal voltages having different polarities, adjusting the polarity of the driving signal voltage cannot improve the residual image and non-uniform flicker caused by poor uniformity of the liquid crystal display. When compensating by dynamically refreshing the images (for example, changing the magnitude of the pixel voltage), it improves the problem of static residual image to a certain extent but might affect the display effect of the panel.

BRIEF SUMMARY OF THE DISCLOSURE

Exemplary embodiments of the present disclosure provide a system and method for image processing, and a display device, which can improve the residual image and flicker uniformity at the time of image display.

According to a first aspect of an embodiment of the present disclosure, there is provided a system for image processing, comprising: a greyscale value selection module, configured to select a plurality of color greyscale values for each of a plurality of sub-pixels, the plurality of sub-pixels being configured to display an image; an optimal common voltage determination module, configured to determine, for each sub-pixel, an optimal common voltage according to the selected color greyscale values; an uniformity determination module, comprising a flicker uniformity determination module and a common voltage uniformity determination module, wherein the flicker uniformity determination module is configured to determine, for each sub-pixel, flicker uniformity, and the common voltage uniformity determination module is configured to determine, for each sub-pixel, common voltage uniformity according to the determined flicker uniformity; and an image compensation module, configured to compensate each sub-pixel according to at least one of the optimal common voltage of each sub-pixel and the common voltage uniformity of each sub-pixel.

According to an embodiment of the present disclosure, the greyscale value selection module is further configured to select a plurality of color greyscale values at equal intervals for each sub-pixel.

According to an embodiment of the present disclosure, the optimal common voltage determination module is further configured to determine, for each sub-pixel, the optimal common voltage according to the common voltage corresponding to an optimal flicker value or an optimal residual image.

According to an embodiment of the present disclosure, the image compensation module is further configured to determine, for each sub-pixel, a pixel voltage according to the optimal common voltage, and compensate each sub-pixel using the determined pixel voltage.

According to an embodiment of the present disclosure, determining the pixel voltage of each sub-pixel according to the optimal common voltage comprises: causing an absolute value of a difference between the optimal common voltage and an initial common voltage to equal an absolute value of a difference between the pixel voltage and an initial pixel voltage, wherein an offset direction between the optimal common voltage and the initial common voltage is opposite to an offset direction between the pixel voltage and the initial pixel voltage. According to the embodiment of the present disclosure, the system further comprises a residual image area determination module configured to determine an area with residual image in the image.

According to an embodiment of the present disclosure, the system further comprises a color block area division module configured to divide the residual image area into a plurality of image color block areas according to a color uniformity threshold and a color luminance threshold.

According to an embodiment of the present disclosure, the color uniformity threshold is determined based on a basic color unit point.

According to an embodiment of the present disclosure, the basic color unit point depends on the number of pixels per inch and a predetermined value.

According to an embodiment of the present disclosure, the color block areas comprise a background area, an intermediate area, and a topcolor area, wherein an area consistency of the color blocks in the background area is smaller than the color uniformity threshold, the area consistency of the color blocks in the intermediate area is greater than the color uniformity threshold and the color luminance thereof is greater than the color luminance threshold, and the area consistency of the color blocks in the topcolor area is greater than or equal to the color uniformity threshold and the color luminance thereof is less than the color luminance threshold.

According to an embodiment of the present disclosure, the image compensation module is further configured to perform at least one of: compensating each sub-pixel in a residual image source area during an image display process; and compensating each sub-pixel in a residual image target area during an image observation process; wherein the image display process lasts from a timing of the image being static to a first timing, the image observation process lasts from the first timing to a second timing, and the second timing is after the first timing; wherein the topcolor area and the background area is the residual image source areas, and the intermediate area is the residual image target area.

According to an embodiment of the present disclosure, the image compensation module is further configured to determine next compensation when it is determined that the image is a static image and an update frequency of the image is lower than a preset frequency.

According to an embodiment of the present disclosure, the greyscale value selection module is further configured to select a plurality of color greyscale values for a mixed sub-pixel, wherein the mixed sub-pixels is formed by mixing the respective sub-pixels in proportion; the optimal common voltage determination module is further configured to determine the optimal common voltage of the mixed sub-pixel according to the selected plurality of color greyscale values for the mixed sub-pixel; the flicker uniformity determination module is further configured to determine the flicker uniformity of the mixed sub-pixel; the common voltage uniformity determination module is further configured to determine the common voltage uniformity of the mixed sub-pixel according to the determined flicker uniformity of the mixed sub-pixel; the image compensation module is further configured to compensate the mixed sub-pixel according to at least one of the optimal common voltage of the mixed sub-pixel and the common voltage uniformity of the mixed sub-pixel.

According to a second aspect of an embodiment of the present disclosure, there is provided a method for image processing, comprising: selecting a plurality of color greyscale values for each of a plurality of sub-pixels, the plurality of sub-pixels being configured to display an image; determining, for each sub-pixel, an optimal common voltage according to the selected color greyscale values; determining, for each sub-pixel, flicker uniformity and determining common voltage uniformity according to the determined flicker uniformity; and compensating each sub-pixel according to at least one of the optimal common voltage of each sub-pixel and the common voltage uniformity of each sub-pixel.

According to an embodiment of the present disclosure, selecting the plurality of color greyscale values for each of the plurality of sub-pixels comprises selecting a plurality of color greyscale values at equal intervals for each sub-pixel.

According to an embodiment of the present disclosure, determining the optimal common voltage of each sub-pixel according to the selected color greyscale values comprises determining, for each sub-pixel, the optimal common voltage according to the common voltage corresponding to an optimal flicker value or an optimal residual image.

According to an embodiment of the present disclosure, compensating each sub-pixel according to the optimal common voltage of each sub-pixel comprises determining, for each sub-pixel, a pixel voltage according to the optimal common voltage, and compensating each sub-pixel using the determined pixel voltage.

According to an embodiment of the present disclosure, determining, for each sub-pixel, the pixel voltage according to the optimal common voltage comprises: causing an absolute value of a difference between the optimal common voltage and an initial common voltage to equal an absolute value of a difference between the pixel voltage and an initial pixel voltage, wherein an offset direction between the optimal common voltage and the initial common voltage is opposite to an offset direction between the pixel voltage and the initial pixel voltage. According to the embodiment of the present disclosure, the method further comprises determining an area with residual image in the image before compensating each sub-pixel.

According to an embodiment of the present disclosure, the method further comprises dividing the residual image area into a plurality of image color block areas according to a color uniformity threshold and a color luminance threshold.

According to an embodiment of the present disclosure, the color uniformity threshold is determined based on a basic color unit point.

According to an embodiment of the present disclosure, the basic color unit point depends on the number of pixels per inch and a predetermined value.

According to an embodiment of the present disclosure, the color block areas comprise a background area, an intermediate area, and a topcolor area, wherein an area consistency of the color blocks in the background area is smaller than the color uniformity threshold, the area consistency of the color blocks in the intermediate area is greater than the color uniformity threshold and the color luminance thereof is greater than the color luminance threshold, and the area consistency of the color blocks in the topcolor area is greater than or equal to the color uniformity threshold and the color luminance thereof is less than the color luminance threshold.

According to an embodiment of the present disclosure, compensating each sub-pixel according to at least one of the optimal common voltage and the common voltage uniformity comprises at least one of: compensating each sub-pixel in a residual image source area during an image display process; and compensating each sub-pixel in a residual image target area during an image observation process; wherein the image display process lasts from a timing of the image being static to a first timing, the image observation process lasts from the first timing to a second timing, and the second timing is after the first timing; wherein the topcolor area and the background area is the residual image source areas, and the intermediate area is the residual image target area.

According to an embodiment of the present disclosure, the method further comprises: determining next compensation when it is determined that the image is a static image and an update frequency of the image is lower than a preset frequency.

According to an embodiment of the present disclosure, the method further comprises: selecting a plurality of color greyscale values according to mixed sub-pixels, wherein the mixed sub-pixels are the sub-pixels formed by mixing the respective sub-pixels in proportion; determining, for the mixed sub-pixels, the optimal common voltage according to the selected color greyscale values; determining, for the mixed sub-pixels, the flicker uniformity, and determining the common voltage uniformity according to the flicker uniformity; and compensating the mixed sub-pixels according to at least one of the optimal common voltage of the mixed sub-pixels and the common voltage uniformity of the mixed sub-pixels.

According to a third aspect of an embodiment of the present disclosure, there is provided a display device comprising any of the above-described systems for image processing.

BRIEF DESCRIPTION OF THE DRAWINGS

In order to illustrate the technical solutions of the embodiments of the present disclosure more clearly, the drawings in the description of the embodiments will be briefly described below. Apparently, the drawings described below are only a few of the embodiments of the present disclosure rather than limit the present disclosure.

DETAILED DESCRIPTION

In order to make the objects, technical solutions and advantages of the embodiments of the present disclosure clearer, the technical solutions of the embodiments of the present disclosure will be described below clearly and completely in conjunction with the accompanying drawings in the embodiments of the present disclosure. It is obvious that the described embodiments are merely part but not all of the embodiments of the present disclosure. Based on the embodiments of the present disclosure, other embodiments obtained by those of ordinary skill in the art without creative labor are also within the scope of protection of the present disclosure.

Hereinafter, the embodiments of the present disclosure will be described in further detail by taking the case where the sub-pixels are red, green and blue sub-pixels respectively and the mixed sub-pixels are mixing sub-pixels formed by mixing the red, green and blue sub-pixels. It will be understood by those skilled in the art that the embodiments of the present disclosure are also applicable to sub-pixels of other colors.

Figure 1:
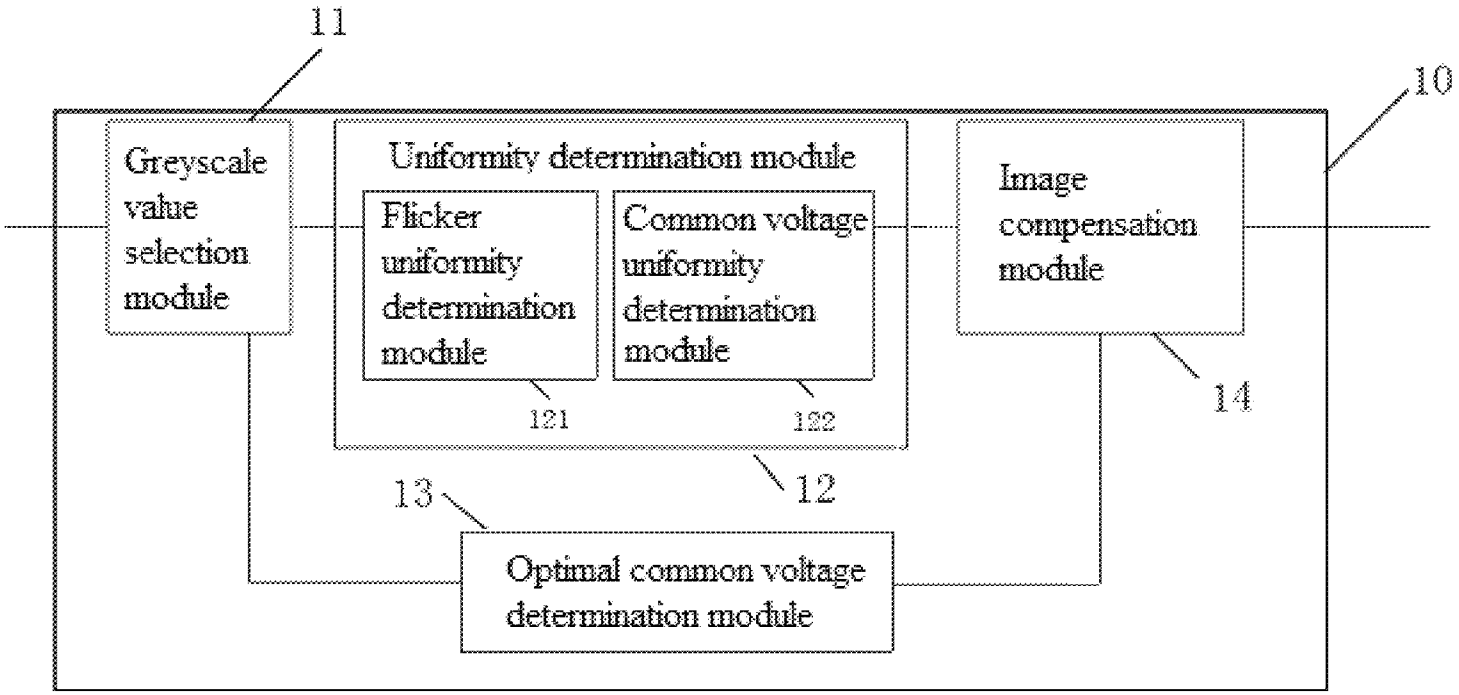
FIG. 1 is a structural block diagram of a system for image processing according to an embodiment of the present disclosure.

FIG. 1 is a structural block diagram of a system for image processing according to an embodiment of the present disclosure.

As shown in FIG. 1, system 10 for image processing according to the present embodiment may comprise a greyscale value selection module 11, an uniformity determination module 12, an optimal common voltage determination module 13, and an image compensation module 14.

As shown in FIG. 1, the greyscale value selection module 11 is configured to select a plurality of color greyscale values for each red sub-pixel, each green sub-pixel, and each blue sub-pixel, respectively, or select a plurality of color greyscale values for each red sub-pixel, each green sub-pixel, each blue sub-pixel, and each mixed sub-pixel, respectively.

By taking the case where there are 256 grayscales for each red sub-pixel, each green sub-pixel, each blue sub-pixel, and each mixed sub-pixel as an example, the selection of color greyscale values for each red sub-pixel, each green sub-pixel, each blue sub-pixel, and each mixed sub-pixel is further described. It should be noted that the embodiments of the present disclosure may also be applied to other sub-pixel with other grayscale numbers.

For the red sub-pixel, first the color greyscale values RED0 and RED255 are selected. Among the remaining grayscales, a plurality of color greyscale values are selected at equal intervals. For example, a color greyscale value is selected every 16 grayscales, to obtain a total of 18 color greyscale values (comprising RED0 and RED255), which are RED0, RED12, RED28, RED44, RED60, RED76, RED92, RED108, RED124, RED140, RED156, RED172, RED188, RED204, RED220, RED236, RED252, and RED255.

Similarly, a plurality of color greyscale values for the green sub-pixel, the blue sub-pixel, and the mixed sub-pixel can be selected as follows:

GREEN0, GREEN12, GREEN28, GREEN44, GREEN60, GREEN76, GREEN92, GREEN108, GREEN124, GREEN140, GREEN156, GREEN172, GREEN188, GREEN204, GREEN220, GREEN236, GREEN252, GREEN255;

BLUE0, BLUE12, BLUE28, BLUE44, BLUE60, BLUE76, BLUE92, BLUE108, BLUE124, BLUE140, BLUE156, BLUE172, BLUE188, BLUE204, BLUE220, BLUE236, BLUE252, BLUE255; and MIX0, MIX12, MIX28, MIX44, MIX60, MIX76, MIX92, MIX108, MIX124, MIX140, MIX156, MIX172, MIX188, MIX204, MIX220, MIX236, MIX252, MIX255.

Alternatively, the greyscale value selection module 11 may also select a plurality of color greyscale values for each red sub-pixel, each green sub-pixel, each blue sub-pixel, and each mixed sub-pixel at intervals other than 16.

Figure 5:
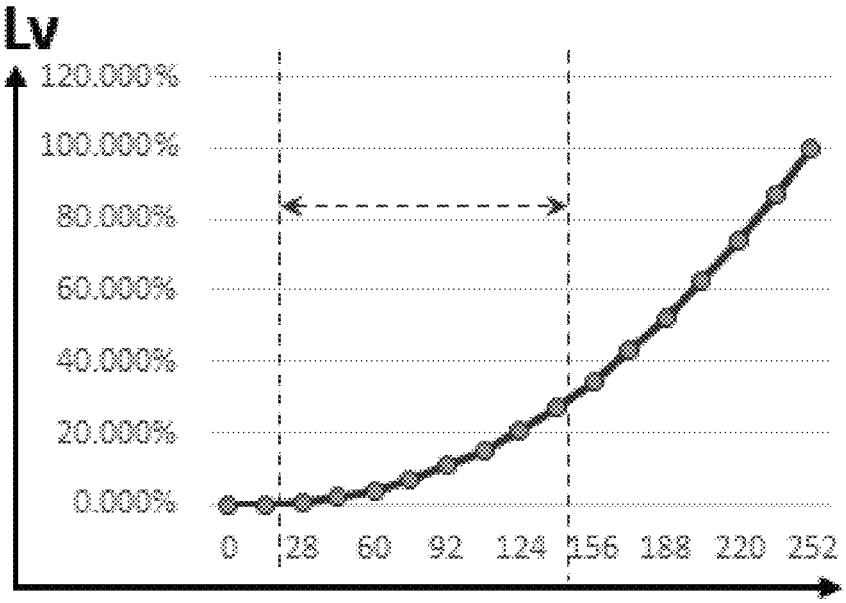
FIG. 5 is a graph illustrating selection of greyscale values for red sub-pixel according to an embodiment of the present disclosure.

In an embodiment of the present disclosure, the greyscale value selection module 11 may further define the selected plurality of color greyscale values within a specific range. For example, as shown in FIG. 5, the grayscales of the red sub-pixel are defined as between 28-140 (comprising the grayscale 28 and the grayscale 140). Therefore, eight color greyscale values for the red sub-pixel are obtained, i.e. RED28, RED44, RED60, RED76, RED92, RED108, RED124, RED140. It is easy for those skilled in the art to understand that, similar to the red sub-pixel, the plurality of color greyscale values for the green sub-pixel, the blue sub-pixel, and the mixed sub-pixel may be further defined as within specific ranges.

By further defining the color greyscale value ranges, the flexible selection of color greyscale values can be achieved.

As shown in FIG. 1, the optimal common voltage determination module 13 is configured to determine an optimal common voltage, which is varied over time, for each red sub-pixel, each green sub-pixel, and each blue sub-pixel, or for each red sub-pixel, each green sub-pixel, each blue sub-pixel, and each mixed sub-pixel, according to the selected color greyscale values. The mixed sub-pixel is the sub-pixel mixed from the red sub-pixel, green sub-pixel, and blue sub-pixel in proportion.

According to an embodiment of the present disclosure, the optimal common voltage determination module 13 may also determine, for each red sub-pixel, each green sub-pixel, each blue sub-pixel, and each mixed sub-pixel, the optimal common voltage, which is varied over time, according to the common voltage corresponding to an optimal flicker value or an optimal residual image.

Specifically, the optimal flicker value is the minimum flicker value when the positive and negative polarity drive voltages of the liquid crystal display are balanced. For example, the optimal flicker value can be obtained by a FMA model or a JEITA model. The optimal residual image corresponds to a situation that the residual image is weakest. The optimal residual image is related to the color value, and is more apparent at some luminance. The optimal common voltage Vcom corresponds to the optimal flicker value. For example, the optimal common voltage can be determined through a FMA model test.

In order to obtain the optimal residual image, that is, in order to optimize (minimize) the residual image, the common voltage (Vcom) is required to be optimal, that is, the corresponding image flicker value is minimum. In general, the flicker value corresponding to the color greyscale value for the mixed sub-pixel MIX127 is the minimum, and the flicker value corresponding other color greyscale values can also be ensured to close to the minimum.

Figure 6:
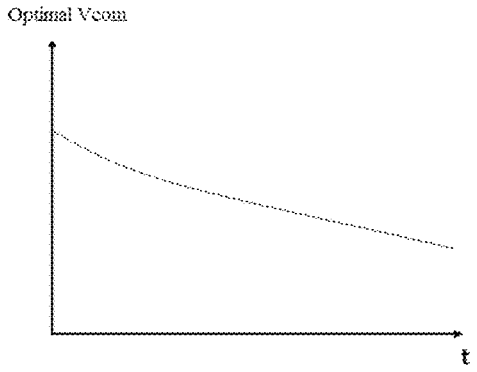
FIG. 6 is a graph illustrating a time-varied optimal common voltage of the red sub-pixel according to an embodiment of the present disclosure.

FIG. 6 shows the time-varied optimal common voltage for the red sub-pixel. As can be seen from FIG. 6, the time-varied optimal common voltage for the red sub-pixel may be a variable that varies over time, rather than a constant amount. It should be noted that FIG. 6 is only a schematic diagram of the time-varied optimal common voltage for the red sub-pixel. However, in practical applications, the curve of the time-varied optimal common voltage for the red sub-pixel might not be the same. Specifically, in order to obtain the time-varied optimal common voltage for the red sub-pixel as shown in FIG. 6, a plurality of pixel luminance in the vicinity of the grayscale 127 (i.e. the color greyscale value RED127) may be selected among the total of 256 grayscales, to determine the optimal common voltage corresponding to the minimum flicker value varied over time. In order to improve the precision, more color greyscale values for each sub-pixel or mixed sub-pixel can be selected. However, in view of the fact that the difference between the color greyscale values in adjacent areas is small, part of area points can be selected in practice.

The time-varied optimal common voltage for the green sub-pixel, the blue sub-pixel, and the mixed sub-pixel is similar to that for the red sub-pixel, and will not be described here.

As shown in FIG. 1, the uniformity determination module 12 may comprise a flicker uniformity determination module 121 and a common voltage uniformity determination module 122.

According to an embodiment of the present disclosure, the flicker uniformity determination module 121 is configured to determine flicker uniformity of each red sub-pixel, each green sub-pixel, and each blue sub-pixel, or flicker uniformity of each red sub-pixel, each green sub-pixel, each blue sub-pixel, and each mixed sub-pixel. The flicker uniformity indicates the difference between the common voltage values Vcom corresponding to the optimal flicker values of the different physical positions of the display panel (i.e. different pixel points). If the difference between the common voltage values Vcom corresponding to the optimal flicker values of a different physical position is large, the flicker uniformity is poor; otherwise, the flicker uniformity is good.

According to an embodiment of the present disclosure, the common voltage uniformity determination module 122 is configured to determine, for each red sub-pixel, each green sub-pixel, each blue sub-pixel, and each mixed sub-pixel, common voltage uniformity, which is varied over time, according to the determined flicker uniformity. Since there is a one-to-one correspondence between the optimal flicker value and the optimal common voltage Vcom, there is also a one-to-one correspondence between the optimal flicker uniformity and the optimal common voltage uniformity.

Figure 7:
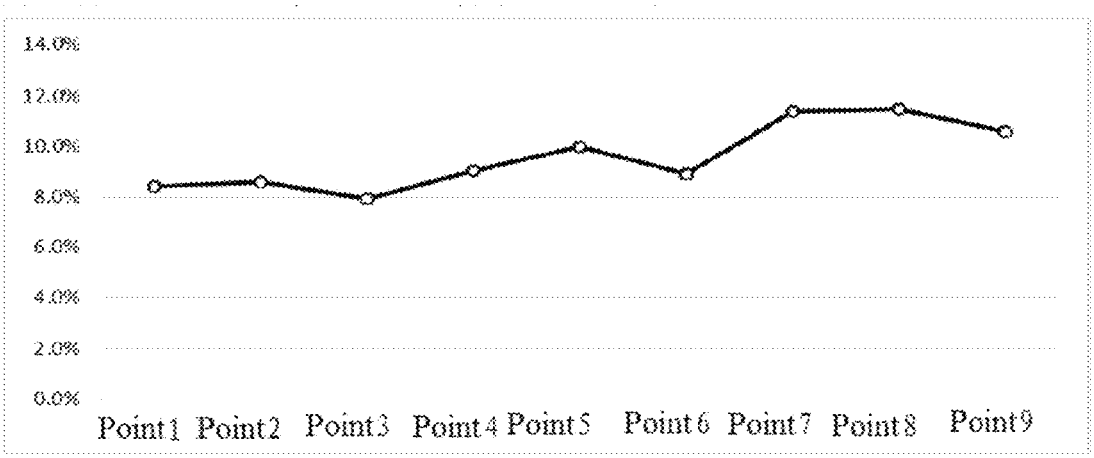
FIG. 7 is a graph illustrating a position-varied common voltage uniformity for the red sub-pixel according to an embodiment of the present disclosure.

FIG. 7 shows differences of the common voltages corresponding to different positions for the red sub-pixel. As can be seen from FIG. 7, nine points at different positions can be selected from the image. The differences between the common voltages corresponding to the different points are different. The differences between the common voltages of the first to sixth points is between 8% and 10%, and the differences between the common voltages of the seventh to ninth points is between 10% and 12%. It can be seen that the uniformity of the common voltages from the first to sixth points is better, while the uniformity of the common voltages from the seventh to ninth points is worse. The uniformity of the common voltages corresponding to the different positions of the green sub-pixel, the blue sub-pixel, and the mixed sub-pixel is similar to that of the red sub-pixel, and is no longer exemplified here.

Since the uniformities of the common voltages at different positions are usually different, the residual image and the flicker uniformity at the time of image display can be further improved according to the difference between the uniformity of the common voltages at different positions at the time of image compensation.

As shown in FIG. 1, the image compensation module 14 is configured to compensate each sub-pixel according to at least one of the time-varied optimal common voltage and the position-varied common voltage uniformity. Therefore, it improves the residual image and the flicker uniformity at the time of image display.

When the image compensation module 14 compensates each sub-pixel according to the time-varied optimal common voltage, it determines, for each red sub-pixel, each green sub-pixel, and each blue sub-pixel, or for each red sub-pixel, each green sub-pixel, each blue sub-pixel, and each mixed sub-pixel, the time-varied pixel voltage according to the time-varied optimal common voltage. In addition, the image compensation module 14 may compensate the red sub-pixel, the green sub-pixel, the blue sub-pixel, or the red sub-pixel, the green sub-pixel, the blue sub-pixel, and the mixed sub-pixel, using the determined amount of compensation of the pixel voltage.

Figure 8:
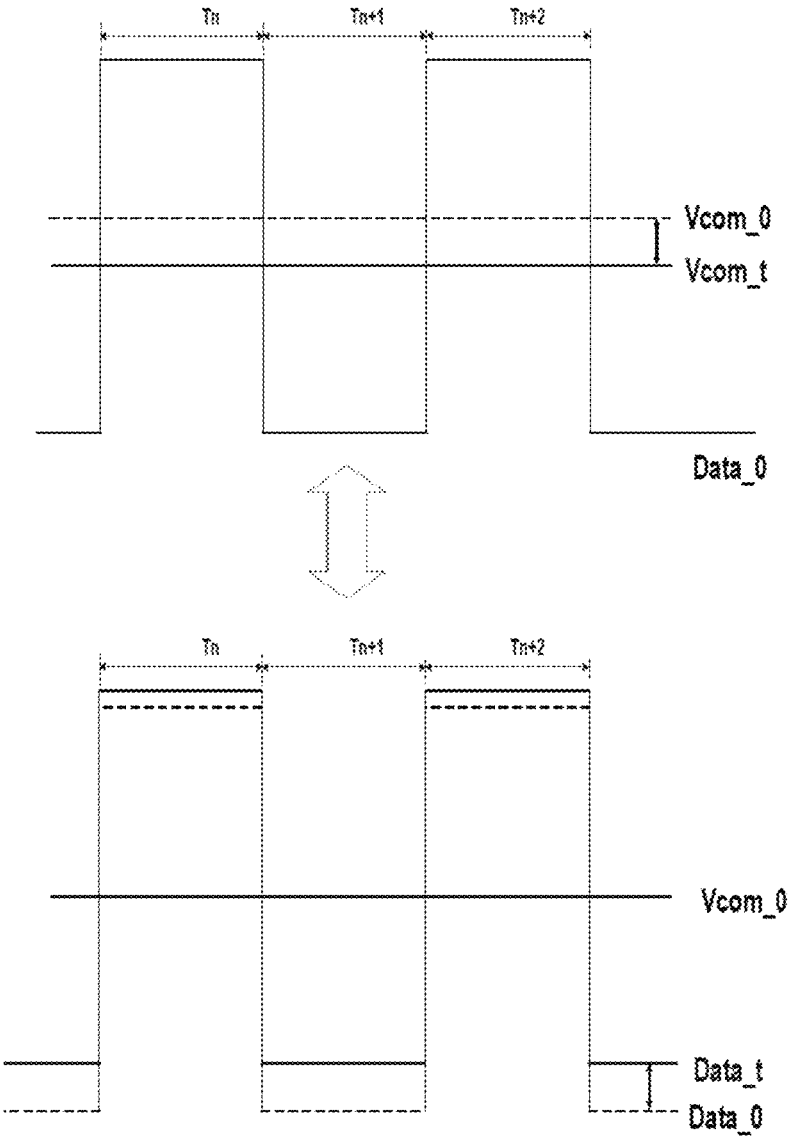
FIG. 8 is a graph illustrating relationship between a common voltage offset and a pixel voltage offset according to an embodiment of the present disclosure.

FIG. 8 shows relationship between common voltage offset amount and pixel voltage offset amount of the red sub-pixel. When determining the pixel voltage of each sub-pixel, as can be seen from FIG. 8, an absolute value of a difference (Vcom_t-Vcom_0) between the time-varied optimal common voltage Vcom_t and an initial common voltage Vcom_0 is equal to an absolute value of the difference (Data_t-Data_0) between the time-varied pixel voltage Data_t and an initial pixel voltage Data_0. The offset direction between the optimal common voltage Vcom_t and the initial common voltage Vcom_0 is opposite to an offset direction between the pixel voltage Data_t and the initial pixel voltage Data_0. That is, Data_t-Data_0=Vcom_0–Vcom_t. The initial common voltage Vcom_0 corresponds to the common voltage of the red sub-pixel when the image is static, and the initial pixel voltage Data_0 corresponds to the pixel voltage of the red sub-pixel when the image is static.

In addition, the relationship between the time-varied optimal common voltage Vcom_t of the green sub-pixel, the blue sub-pixel, and the mixed sub-pixel is similar to that of the red sub-pixel, and will not be described here.

Figure 9:
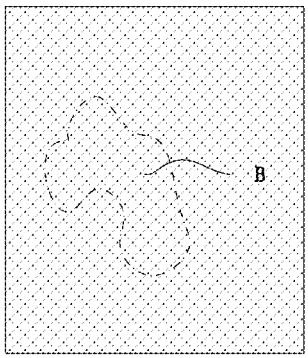
FIG. 9 is an image compensated using pixel voltage according to an embodiment of the present disclosure.

FIG. 9 shows a pixel voltage-compensated image according to an embodiment of the present disclosure. As shown in FIG. 9, according to the embodiment, it is possible to significantly improve the residual image and flicker uniformity at the time of image display.

According to an embodiment of the present disclosure, the system 10 may further comprise a storage device configured to store the color greyscale values of each red sub-pixel, each green sub-pixel, and each blue sub-pixel, or the color greyscale values of each red sub-pixel, each green sub-pixel, each blue sub-pixel, and each mixed sub-pixel. The uniformity determination module 12 and the optimal common voltage determination module 13 may read the color greyscale values of each red sub-pixel, each green sub-pixel, and each blue sub-pixel, or the color greyscale values of each red sub-pixel, each green sub-pixel, each blue sub-pixel, and each mixed sub-pixel from the storage device.

Figure 2:
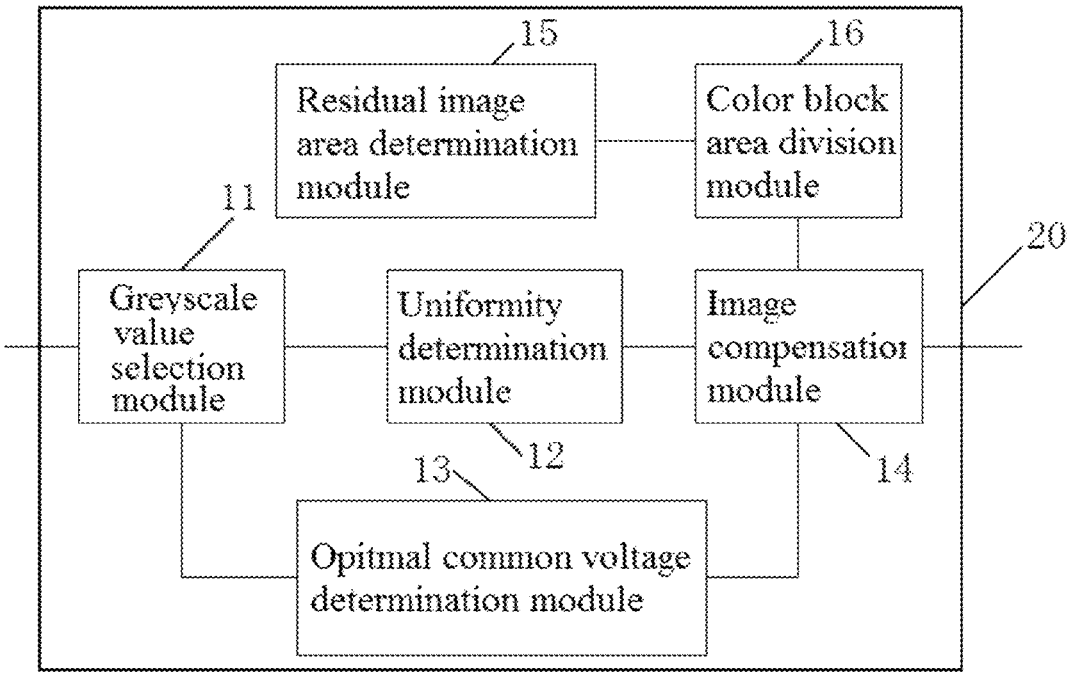
FIG. 2 is a structural block diagram of a system for image processing according to another embodiment of the present disclosure.

FIG. 2 shows a structural block diagram of a system 20 for image processing according to another embodiment of the present disclosure.

Different from the system 10 in FIG. 1, the system 20 further comprises a residual image area determination module 15. The residual image area determination module 15 is configured to determine an area with residual image in the image. According to the embodiment of the present disclosure, when determining the area with residual image, the edge of the residual image in the image can be first identified. Then the area with residual image is determined in response to the identified edge of the residual image. According to the embodiment of the present disclosure, an existing image edge detection algorithm may be employed to identify the edge of the residual image. The present invention is not specifically limited thereto.

As shown in FIG. 2, the system 20 may further comprise a color block area division module 16. The color block area division module 16 is configured to divide the residual image area into image color block areas according to a color uniformity threshold and a color luminance threshold, so as to divide the image into different color block areas according to an color consistency. The color luminance threshold is a value corresponding to the vertical dashed line in FIG. 5.

Specifically, the color block area division module 16 may further be configured to determine the color uniformity threshold based on a basic color unit point. The basic color unit point can be defined as:

basic color unit point=$n$*PPI (i.e. the number of pixels per inch), where n may be a large value, for example, n can be set to the number of pixels that can be clearly identified by the human eye. When calculating the color uniformity threshold in basic unit of the basic color unit point, it can be implemented through calculating a standard deviation and a complex process capability index (CPK) by using statistical methods.

According to an embodiment of the present disclosure, the color block areas comprise a background area, an intermediate area, and a topcolor area. In the background area, an area consistency of the color blocks is smaller than the color uniformity threshold. In the intermediate area, the area consistency of the color blocks is greater than the color uniformity threshold and the color luminance thereof is greater than the color luminance threshold. In the topcolor area, the area consistency of the color blocks is greater than or equal to the color uniformity threshold and the color luminance thereof is less than the color luminance threshold. Further, the topcolor area and the background color area may be referred as a residual image source area, and the intermediate area may be referred as a residual target area.

As shown in FIG. 2, the image compensation module 14 is further configured to compensate each sub-pixel in the residual image source area during an image display process (i.e. "process compensation", also referred to as "real time compensation"). Specifically, the compensation amount of the common voltage can be calculated according to the determined optimal common voltage (as shown in FIG. 6) and the common voltage uniformity (as shown in FIG. 7). The obtained compensation amount of the common voltage is compensated to each sub-pixel in the residual image source area according to the method shown in FIG. 8. Thus, this "process compensation" can compensate the display process, and improve the flicker uniformity in the image display process, thereby improving the residual image of the displayed result. The image display process lasts from a timing of the image being static to a first timing t1, and the first timing can be set in advance.

As shown in FIG. 2, the image compensation module 14 is further configured to compensate each sub-pixel in the residual image target area during an image observation process (i.e. "result compensation", also referred to as "target area compensation"). Specifically, when a certain image or image area is static for a long time, the amount of compensation of the common voltage can be calculated according to the determined optimal common voltage (as shown in FIG. 6) and the common voltage uniformity (as shown in FIG. 7). The obtained compensation amount of the common voltage is compensated to each sub-pixel in the entire image area or the residual image target area after switching according to the method as shown in FIG. 8. Thus, this "result compensation" may compensate the displayed result, improving the residual image and flicker uniformity of the displayed result. The image observation process lasts from the first timing t1 to a second timing t2, the second timing can be set in advance, and the second timing is after the first timing, i.e. t2>t1.

As shown in FIG. 2, the image compensation module 14 may further be configured to perform the above-described "process compensation" and "result compensation" on the display image at the same time. Therefore, it achieves full process compensation, improving the residual image and flicker uniformity at the time of image display.

According to an embodiment of the present disclosure, the image compensation module 14 may further be configured to determine next compensation when it is determined that the image is a static image and an update frequency of the image is lower than a preset frequency; otherwise, it is determined that there is no need for the next compensation. That is, if it is determined that the image is a motion image, it is determined that there is no need for the next compensation; and if it is determined that the image is a static image but the image update frequency is equal to or greater than the preset frequency, it is determined that there is no need for the next compensation.

Figure 3:
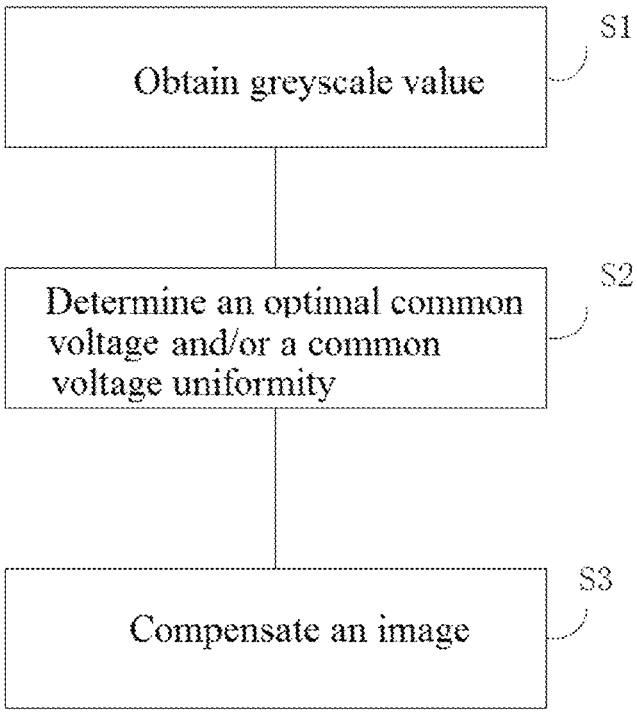
FIG. 3 is a flow chart depicting a method for image processing according to an embodiment of the present disclosure.

FIG. 3 shows a flow chart of a method for image processing according to an embodiment of the present disclosure.

As shown in FIG. 3, in step S1, the greyscale values are obtained. Specifically, a plurality of color greyscale values are selected for each red sub-pixel, each green sub-pixel, and each blue sub-pixel, or for each red sub-pixel, each green sub-pixel, each blue sub-pixel, and each mixed sub-pixel, respectively.

Further, the plurality of color greyscale values can be selected at equal intervals. As shown in FIG. 5, the selected plurality of greyscale values can also be further screened. The specific selection method and the method of further defining the range are mentioned above, and will not be repeated here.

In step S2, at least one of the time-varied optimal common voltage and the position-varied common voltage uniformity is determined.

Specifically, when determining the time-varied optimal common voltage, the time-varied optimal common voltage for each red sub-pixel, each green sub-pixel, and each blue sub-pixel, or for each red sub-pixel, each green sub-pixel, each blue sub-pixel, and each mixed sub-pixel is determined according to the selected color greyscale values.

According to an embodiment of the present disclosure, when determining the time-varied optimal common voltage, it is also possible to determine the time-varied optimal common voltage, according to the common voltage corresponding to the optimal flicker value or the optimal residual image of each red sub-pixel, each green sub-pixel, and each blue sub-pixel, or of each red sub-pixel, each green sub-pixel, each blue sub-pixel, and each mixed sub-pixel. Taking the red sub-pixel as an example, the common voltage Vcom1 corresponding to the optimal flicker value of the red sub-pixel can be obtained, the common voltage Vcom2 can corresponding to the optimal residual image of the red sub-pixel be obtained. Then the time-varied optimal common voltage is determined according to Vcom1 and Vcom2.

An example of the time-varied optimal common voltage of the red sub-pixel has been given above, and will not be repeated here.

Specifically, when determining the position-varied common voltage uniformity, the flicker uniformity of each red sub-pixel, each green sub-pixel, and each blue sub-pixel, or the flicker uniformity of each red sub-pixel, each green sub-pixel, each blue sub-pixel, and each mixed sub-pixel is first determined according to the selected color greyscale values. Then the position-varied common voltage uniformity of each red sub-pixel, each green sub-pixel, and each blue sub-pixel, or the position-varied common voltage uniformity of each red sub-pixel, each green sub-pixel, each blue sub-pixel, and each mixed sub-pixel is determined according to the flicker uniformity.

In the above, an example of the position-varied common voltage uniformity of the red sub-pixel has been given. The common voltage uniformity of the green sub-pixel, the blue sub-pixel, and the mixed sub-pixel is similar to the red sub-pixel, and will not be repeated herein.

In step S3, each sub-pixel is compensated according to at least one of the time-varied optimal common voltage and the position-varied common voltage uniformity.

Specifically, in order to compensate each sub-pixel according to the time-varied optimal common voltage, the time-varied pixel voltage can be determined according to the time-varied optimal common voltage. The pixel voltage of each sub-pixel can be compensated according to the determined amount of compensation of the pixel voltage, for each red sub-pixel, each green sub-pixel, and each blue sub-pixel, or for each red sub-pixel, each green sub-pixel, each blue sub-pixel, and each mixed sub-pixel, respectively.

Figure 4:
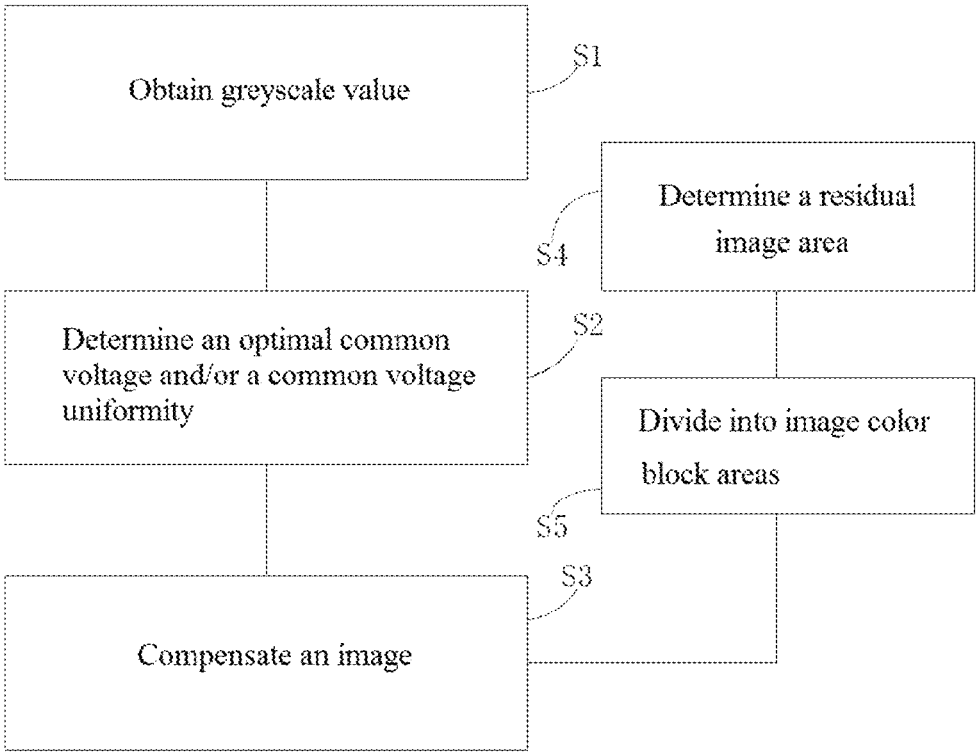
FIG. 4 is a flow chart depicting a method for image processing according to another embodiment of the present disclosure.

FIG. 8 shows the relationship between common voltage offset amount of the red sub-pixel and pixel voltage offset amount of the red sub-pixel. As can be seen from FIG. 8, the absolute value of the difference (Vcom_t-Vcom_0) between the time-varied optimal common voltage Vcom_t and the initial common voltage Vcom_0 is equal to the absolute value of the difference (Data_t-Data_0) between the time-varied pixel voltage Data_t and the initial pixel voltage Data_0, and the offset direction between the optimal common voltage Vcom_t and the initial common voltage Vcom_0 is opposite to the offset direction between the pixel voltage Data_t and the initial pixel voltage Data_0, i.e. Data_t-Data_0=Vcom_0−Vcom_t. The relationship, for each red sub-pixel, each green sub-pixel, each blue sub-pixel, and each mixed sub-pixel, between the time-varied optimal common voltage Vcom_t and the time-varied pixel voltage, is similar to the red sub-pixel, and will not be described here. FIG. 4 shows a flow chart of a method for image processing according to another embodiment of the present disclosure.

In step S4, the residual image generation area in the image is determined.

According to an embodiment of the present disclosure, when determining the residual image area, the edge of the residual image in the image can be first identified, and then the residual image area is determined through the identified edge of the residual image. According to the embodiment of the present disclosure, an existing image edge detection algorithm may be employed when identifying the edge of the residual image. The embodiments of the present disclosure are not specifically limited thereto.

In step S5, the residual image area is divided into a plurality of image color block areas according to the color uniformity threshold and the color luminance threshold, so as to divide the image into different color areas according to the color consistency. The color uniformity threshold can be determined according to a basic color unit point. The basic color unit point has been defined above and will not be described here.

According to an embodiment of the present disclosure, the color block areas comprise a background area, an intermediate area, and a topcolor area. In the background area, the area consistency of the color block is less than the color uniformity threshold. In the intermediate area, the area consistency of the color block is greater than the color uniformity threshold and the color luminance thereof is greater than the color luminance threshold. In the topcolor area, the area consistency of the color block is greater than or equal to the color uniformity threshold, and the color luminance thereof is less than the color luminance threshold. Further, the top color area and the background color area may be defined as residual image source areas, and the intermediate area may be defined as a residual image target area.

As shown in FIG. 4, according to the embodiment of the present disclosure, in step S3, each sub-pixel in the residual image source area is compensated during an image display process (i.e. "process compensation"). Thus, this "process compensation" may compensate the display process to improve the flicker uniformity in the image display process, thereby improving the residual image of the displayed result. The image display process lasts from the timing of the image being static to the first timing t1, and the first timing can be set in advance.

As shown in FIG. 4, according to the embodiment of the present disclosure, in step S3, each sub-pixel in the residual image target area is also compensated during an image observation process (i.e. "result compensation"). Thus, this "result compensation" can compensate the displayed result, improving the residual image and flicker uniformity of the displayed result. The image observation process lasts from the first timing t1 to the second timing t2, the second timing t2 can be set in advance, and the second timing is after the first timing, i.e. t2>t1.

According to an embodiment of the present disclosure, after the sub-pixel compensation is accomplished, the method for image processing may further determine next compensation when it is determined that the image is a static image and the update frequency of the image is lower than the preset frequency; otherwise, determine that there is no need for the next compensation. That is, when it is determined that the image is a motion image, it is determined that there is no need for the next compensation; or when it is determined that the image is a static image but the image update frequency is equal to or greater than the preset frequency, it is determined that there is no need for the next compensation.

Similarly, an embodiment of the present disclosure further provides a display device comprising any of the above-described systems for image processing. Therefore, it improves the residual image and flicker uniformity at the time of image display.

It should be noted that the display device according to the embodiment of the present disclosure may be any product or component having a display function, such as a display panel, an electronic paper, a mobile phone, a tablet computer, a television set, a notebook computer, a digital photo frame, a navigator, or the like.

The foregoing are only specific embodiments of the present disclosure, but the scope of protection of the present disclosure is not limited thereto, and any variation or substitution easily conceivable to those skilled in the art, within the technical scope disclosed in this disclosure, shall be covered by the scope of protection of the present disclosure. Accordingly, the scope of protection of the present disclosure should be based on the scope of protection of the claims.

What is claimed is:

1. A system for image processing, comprising:

a processor configured to:

select a plurality of color greyscale values for each of a plurality of sub-pixels, the plurality of sub-pixels configured to display an image;

determine, for each sub-pixel, an optimal common voltage according to the selected color greyscale values;

determine flicker uniformity of each sub-pixel, and determine, for each sub-pixel, common voltage uniformity according to the determined flicker uniformity; and compensate each sub-pixel according to at least one of the optimal common voltage of each sub-pixel and the common voltage uniformity of each sub-pixel.

2. The system according to claim 1, wherein the processor is further configured to select a plurality of color greyscale values at equal intervals for each sub-pixel.

3. The system according to claim 1, wherein the processor is further configured to determine, for each sub-pixel, the optimal common voltage according to the common voltage corresponding to an optimal flicker value or an optimal residual image.

4. The system according to claim 1, wherein the processor is further configured to determine, for each sub-pixel, a pixel voltage according to the optimal common voltage, and compensate each sub-pixel using the determined pixel voltage.

5. The system according to claim 4, wherein determining the pixel voltage of each sub-pixel according to the optimal common voltage comprises: causing an absolute value of a difference between the optimal common voltage and an initial common voltage to equal an absolute value of a difference between the pixel voltage and an initial pixel voltage, wherein an offset direction between the optimal common voltage and the initial common voltage is opposite to an offset direction between the pixel voltage and the initial pixel voltage.

6. The system according to claim 1, wherein the processor is configured to determine an area with residual image in the image.

7. The system according to claim 6, wherein the processor is configured to divide the residual image area into a plurality of image color block areas according to a color uniformity threshold and a color luminance threshold.

8. The system according to claim 7, wherein the color uniformity threshold is determined based on a basic color unit point.

9. The system according to claim 8, wherein the basic color unit point depends on the number of pixels per inch and a predetermined value.

10. The system according to claim 7, wherein the color block areas comprise a background area, an intermediate area, and a topcolor area, wherein an area consistency of the color blocks in the background area is smaller than the color uniformity threshold, the area consistency of the color blocks in the intermediate area is greater than the color uniformity threshold and the color luminance thereof is greater than the color luminance threshold, and the area consistency of the color blocks in the topcolor area is greater than or equal to the color uniformity threshold and the color luminance thereof is less than the color luminance threshold.

11. The system according to claim 10, wherein the processor is further configured to perform at least one of: compensating each sub-pixel in a residual image source area during an image display process; and compensating each sub-pixel in a residual image target area during an image observation process;

wherein the image display process lasts from a timing of the image being static to a first timing, the image observation process lasts from the first timing to a second timing, and the second timing is after the first timing; and wherein the topcolor area and the background area is the residual image source areas, and the intermediate area is the residual image target area.

12. The system according to claim 1, wherein the processor is further configured to determine a next compensation when it is determined that the image is a static image and an update frequency of the image is lower than a preset frequency.

13. The system according to claim 1, wherein the processor is further configured to:

select a plurality of color greyscale values for a mixed sub-pixel, wherein the mixed sub-pixels is formed by mixing the respective sub-pixels in proportion;

determine the optimal common voltage of the mixed sub-pixel according to the selected plurality of color greyscale values for the mixed sub-pixel;

determine the flicker uniformity of the mixed sub-pixel;

determine the common voltage uniformity of the mixed sub-pixel according to the determined flicker uniformity of the mixed sub-pixel; and compensate the mixed sub-pixel according to at least one of the optimal common voltage of the mixed sub-pixel and the common voltage uniformity of the mixed sub-pixel.

14. A method for image processing, comprising:

selecting a plurality of color greyscale values for each of a plurality of sub-pixels, the plurality of sub-pixels being configured to display an image;

determining, for each sub-pixel, an optimal common voltage according to the selected color greyscale values;

determining flicker uniformity of each sub-pixel and determining common voltage uniformity according to the determined flicker uniformity; and compensating each sub-pixel according to at least one of the optimal common voltage of each sub-pixel and the common voltage uniformity of each sub-pixel.

15. The method according to claim 14, wherein selecting the plurality of color greyscale values for each of the plurality of sub-pixels comprises selecting a plurality of color greyscale values at equal intervals for each sub-pixel.

16. The method according to claim 14, wherein determining the optimal common voltage of each sub-pixel according to the selected color greyscale values comprises determining, for each sub-pixel, the optimal common voltage according to the common voltage corresponding to an optimal flicker value or an optimal residual image.

17. The method according to claim 14, wherein compensating each sub-pixel according to the optimal common voltage of each sub-pixel comprises determining, for each sub-pixel, a pixel voltage according to the optimal common voltage, and compensating each sub-pixel using the determined pixel voltage.

18. The method according to claim 17, wherein determining, for each sub-pixel, the pixel voltage according to the optimal common voltage comprises: causing an absolute value of a difference between the optimal common voltage and an initial common voltage to equal an absolute value of a difference between the pixel voltage and an initial pixel voltage, wherein an offset direction between the optimal common voltage and the initial common voltage is opposite to an offset direction between the pixel voltage and the initial pixel voltage.

19. The method according to claim 14, further comprising determining an area with residual image in the image before compensating each sub-pixel.

20. The method according to claim 19, further comprising dividing the residual image area into a plurality of image color block areas according to a color uniformity threshold and a color luminance threshold.

* * * * *